US006213899B1

(12) United States Patent
Maske

(10) Patent No.: US 6,213,899 B1
(45) Date of Patent: Apr. 10, 2001

(54) METHOD FOR TEACHING BASKETBALL SHOOTING TECHNIQUES

(76) Inventor: Jody D. Maske, 136 W. Cedar, Newell, IA (US) 50568

( * ) Notice: Subject to any disclaimer, the term of this patent is extended or adjusted under 35 U.S.C. 154(b) by 0 days.

(21) Appl. No.: 09/413,094

(22) Filed: Oct. 8, 1999

(51) Int. Cl.[7] ..... A63B 57/00
(52) U.S. Cl. ..... 473/409; 473/447
(58) Field of Search ..... 473/447, 448, 473/450, 409, 429, 432, 433, 438–439; 312/297; 181/30; 160/229.1, 135; 40/605

(56) References Cited

U.S. PATENT DOCUMENTS

| | | | | |
|---|---|---|---|---|
| 488,747 | * | 12/1892 | Barrett | 160/229.1 |
| 3,232,370 | * | 2/1966 | Jaffe | 181/30 |
| 3,810,618 | * | 5/1974 | Nedwick | 473/439 |
| 4,538,808 | * | 9/1985 | Holland | 473/447 |
| 4,565,527 | | 1/1986 | Burchett . | |
| 4,623,148 | | 11/1986 | Juhl . | |
| 4,717,149 | | 1/1988 | Juhl . | |
| 4,989,862 | | 2/1991 | Curtis . | |
| 5,160,138 | | 11/1992 | Sanders . | |
| 5,312,099 | * | 5/1994 | Oliver, Sr. | 473/433 |
| 5,324,026 | | 6/1994 | Conlon . | |
| 5,354,048 | | 10/1994 | Winesberry . | |
| 5,527,185 | | 6/1996 | Davis . | |
| 5,599,016 | | 2/1997 | Larkin . | |
| 5,642,879 | | 7/1997 | Rodriguez . | |
| 5,738,600 | | 4/1998 | Fouts . | |
| 5,800,291 | | 9/1998 | Grover . | |
| 5,813,926 | | 9/1998 | Vance . | |
| 5,816,951 | | 10/1998 | Hudock . | |
| 5,816,952 | | 10/1998 | Blevins . | |
| 5,878,802 | * | 3/1999 | Richter et al. | 160/135 |
| 6,009,930 | * | 4/1999 | Jantschek | 160/135 |

* cited by examiner

*Primary Examiner*—Stephen F. Gerrity
*Assistant Examiner*—Mitra Aryanpour
(74) *Attorney, Agent, or Firm*—Henderson & Sturm LLP

(57) ABSTRACT

A device for teaching proper basketball shooting techniques including a pair of vertically disposed, horizontally spaced transparent panels that form a shooter restricting enclosure having a substantially open front and rear. The panel on the side of the shooting hand extends to the rear further than the panel on the side of the off hand. The enclosure is positioned so that the open front is directed toward the basket and the shooter is positioned with the shooting hand, elbow, and corresponding knee and foot between the panels, with their off hand side knee and foot positioned outside of the enclosure, and their torso positioned at the rear edge of the off hand side panel. A vertically adjustable defensive obstruction is movably attached to the front edge of one of the panels to simulate a defensive player over which the shot must be made. The device is supported on floor engaging wheels so that the device will move if contacted by the shooter and alert the coaching staff of improper shooting technique. An optional L-shaped attachment panel allows the shooter's entire body to be positioned within an enclosure.

9 Claims, 2 Drawing Sheets

METHOD FOR TEACHING BASKETBALL SHOOTING TECHNIQUES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the field of athletic training devices, and more particularly to a device for teaching proper basketball shooting techniques.

2. Description of the Related Art

As can be seen by reference to the following U.S. Pat. Nos. Des. 370,242; 3,820,783; 4,538,808; 4,565,527; 4,623,148; 4,717,149; 4,989,862; 5,160,138; 5,324,026; 5,354,048; 5,527,185; 5,599,016; 5,642,879; 5,738,600; 5,800,291; 5,813,926; 5,816,951; and 5,816,952, the prior art is replete with myriad and diverse devices for teaching basketball skills.

Most patents disclosing various basketball training and shooting development devices are directed toward devices that are strapped to the arm, torso or hand of the player. Examples of some of these devices are included in U.S. Pat. Nos. 3,829,783 and 5,816,952. A number of other patents require the shooter to shoot the ball through a rectangular opening (U.S. Pat. No. 4,565,527); over a blocking screen or obstruction (U.S. Pat. Nos. 5,160,138; 5,642,879; 5800,291; Des. 370,242; 4989,862; 5,527,185; 5816,951); between ropes which define a shooting lane (U.S. Pat. No. 5,354,048); over bars (U.S. Pat. No. 5,599,016); between uprights (U.S. Pat. No. 5,813,926); and confined within a cage having resilient arms to simulate blockers (U.S. Pat. No. 4,538,808).

While all of the aforementioned prior art constructions are more than adequate for the basic purpose and function for which they have been specifically designed, they are uniformly deficient with respect to their failure to provide a simple, efficient, and practical device for teaching proper basketball shooting techniques.

As a consequence of the foregoing situation, there has existed a longstanding need for a new and improved device for teaching shooters and the provision of such a construction and method are stated objectives of the present invention.

BRIEF SUMMARY OF THE INVENTION

Briefly stated, the present invention provides a device for teaching proper basketball shooting techniques including a pair of vertically disposed, horizontally spaced transparent panels that form a shooter restricting enclosure having a substantially open front and rear. The panel on the side of the shooting hand extends to the rear further than the panel on the side of the off hand. The enclosure is positioned so that the open front is directed toward the basket and the shooter is positioned with the shooting hand, elbow, and corresponding knee and foot between the panels, with their off hand side knee and foot positioned outside of the enclosure, and their torso positioned at the rear edge of the offhand side panel. A vertically adjustable defensive obstruction is movably attached to the front edge of one of the panels to simulate a defensive player over which the shot must be made. The device is supported on floor engaging wheels so that the device will move if contacted by the shooter and alert the coaching staff of improper shooting technique. An optional L-shaped attachment panel allows the shooter's entire body to be positioned within an enclosure.

DETAILED DESCRIPTION OF THE INVENTION

Figure 1:
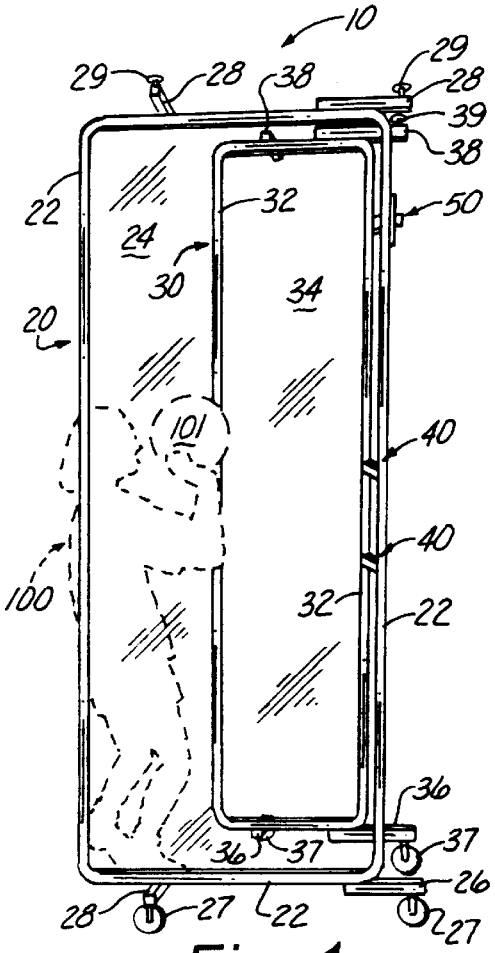
FIG. 1 is a perspective view taken from the right side of the teaching device of the present invention illustrating a shooter prepared to shoot a basketball.
Figure 5:
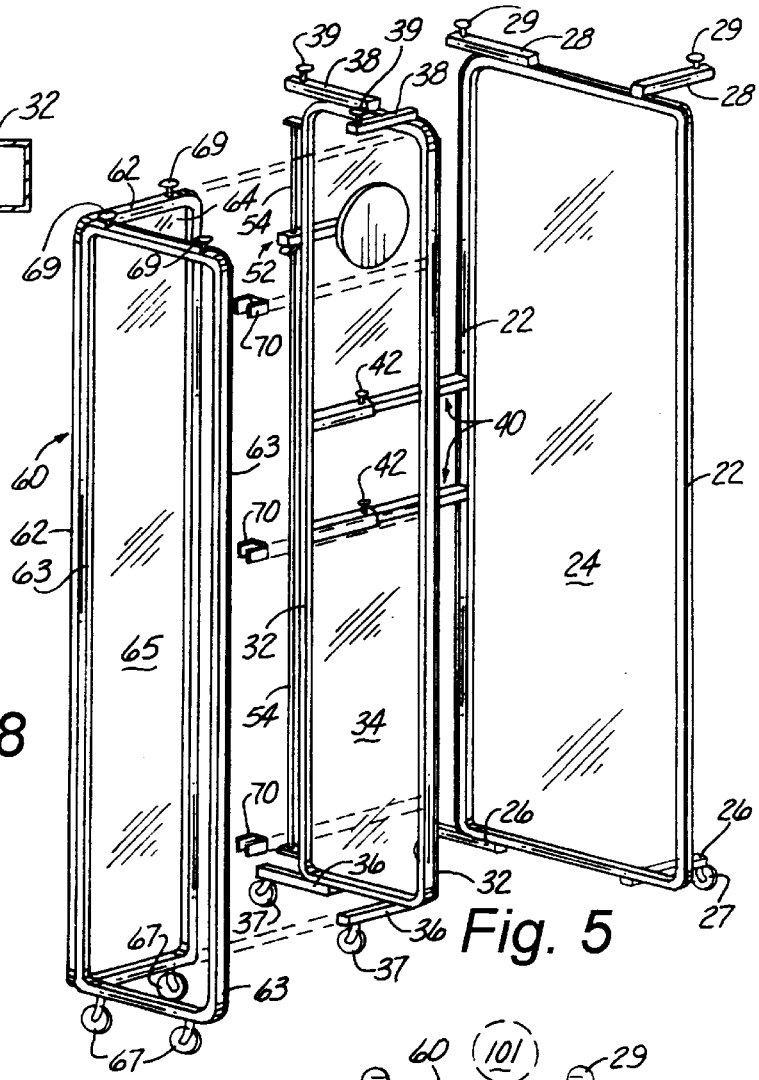
FIG. 5 is an exploded perspective view taken from the right side of the rear of the teaching device illustrating an optional attachment that allows the shooter's entire body to be positioned within the enclosure of the teaching device.
Figure 6:
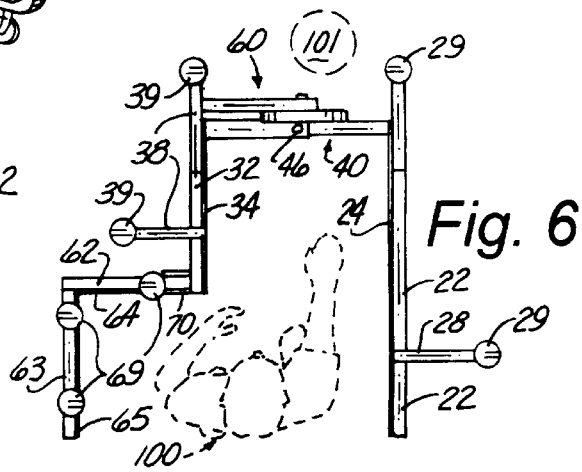
FIG. 6 is a top plan view illustrating the optional attachment secured to the teaching device.

As can be seen by reference to the drawings, and in particular to FIG. 1, the teaching device that forms the basis of the present invention is designated generally by the reference number (10). The device (10) includes a first vertical panel (20), a second vertical panel (30), horizontally adjustable connector bars (40) interconnecting the panels (20) and (30), and a vertically adjustable defensive obstruction (50) movably attached to the front edge of the second panel (30). An optional attachment panel (60) is secured to the second panel (30) as illustrated in FIGS. 5 and 6.

The first panel (20) includes a rectangular peripheral frame (22) having a planar sheet (24) of transparent material attached with screws (25) (FIG. 8) or other suitable fastening means. The bottom edge of the frame (22) carries outwardly extending bottom brackets (26) that support floor engaging wheels (27). The top edge of the frame (22) carries top brackets (28) that are vertically aligned with the bottom brackets (26) and carries adjustable levelers (29).

The second panel (30) has a frame (32) with an attached transparent sheet (34). Bottom brackets (36) support wheels (37), and top brackets (38) support levelers (39). In the preferred embodiment, the first panel (20) has a height of about 96 inches and a depth of about 33 inches; while the second panel (30) has a height of about 96 inches and a depth of about 15 inches. Thus, the transparent sheets (24) and (34)

may be cut from a single sheet of material of the standard size of 48 inches by 96 inches.

Figure 3:
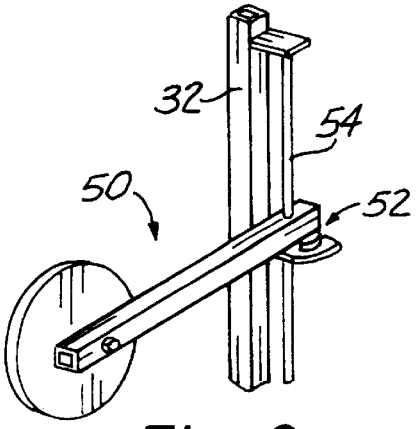
FIG. 3 is an enlarged partial perspective view showing the defensive obstruction attached to the front of the teaching device.
Figure 4:
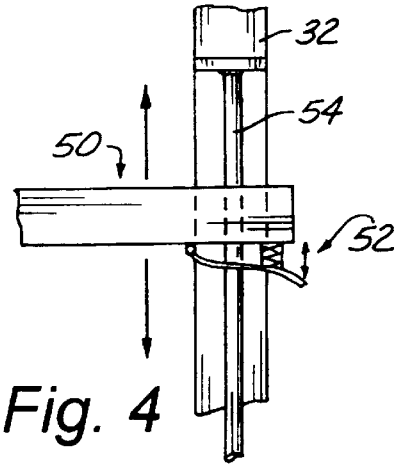
FIG. 4 is an enlarged partial front elevational view illustrating the spring clamp that provides for vertical adjustment of the defensive obstruction.
Figure 8:
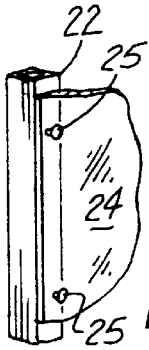
FIG. 8 is an enlarged partial perspective view illustrating the plexiglass panel attached to the frame by screw fasteners.
Figure 9:
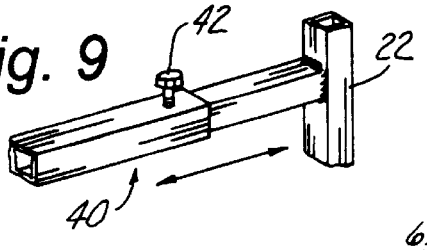
FIG. 9 is an enlarged partial perspective view showing the telescopic connection allowing width adjustment of the teaching device.

As best shown in FIGS. 5 and 9, the panels (20) and (30) are attached by a pair of telescoping connectors (40) that include a set screw (42) that secures the panels (20) and (30) in the desired horizontally spaced relationship. In the preferred embodiment, the horizontal distance between the panels (20) and (30) ranges from 11 to 15 inches. As best illustrated in FIGS. 3, 4 and 8, the defensive obstruction (50) is slidably and adjustably attached to the front edge of the frame (32) by the interaction of the spring clip (52) and the rod (54). The obstruction (50) may be positioned at various levels to simulate defensive players of different heights, or positioned at a lower level where it does not act as an obstruction to shooting.

Figure 7:
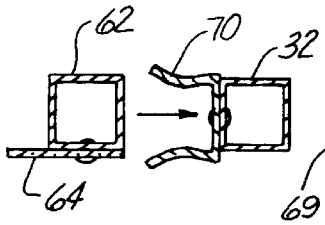
FIG. 7 is an enlarged sectional view illustrating a friction clip for securing the optional attachment to the teaching device.

As shown in FIGS. 5–7 the optional attachment panel (60) includes a pair of rectangular frames (62) and (63) with attached transparent sheets (64) and (65). Floor engaging wheels (67) are attached to the bottom edge of the frames (62) and (63), and levelers (69) are attached to the top edge. The attachment panel (60) is secured to the second panel (30) by the friction clip (70) (FIG. 7) or by other suitable means.

It is to be understood that although the illustrations of FIGS. 1–2 and 5–6 show a right handed shooter (100) shooting a basketball (101), the device (10) maybe used by left handed shooters by simply inverting the device (10). Also, it is to be understood that wheels and levelers are interchangeable and optional.

Figure 2:
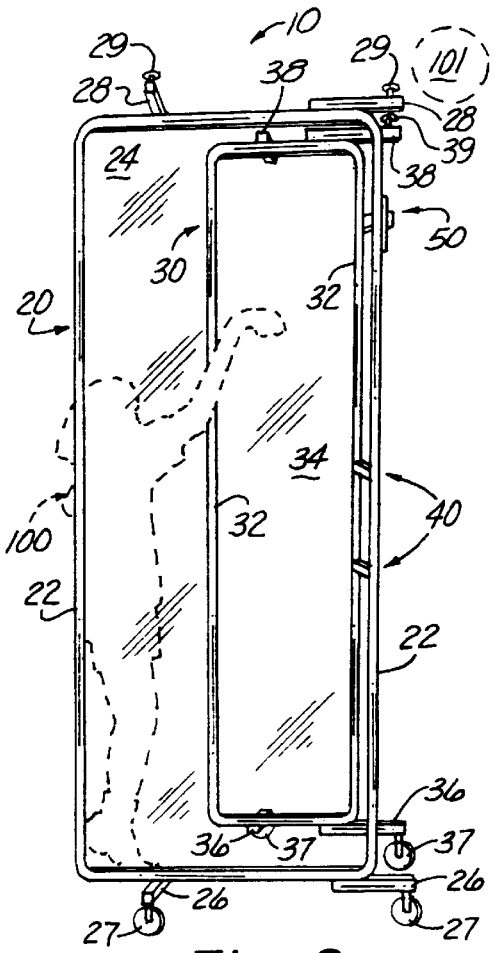
FIG. 2 is a perspective view similar to FIG. 1, but showing the shooter immediately after a shot is taken.

In use, the shooter (100) is positioned in the enclosure as illustrated in FIGS. 1–2 and 6, and the obstruction (50) is positioned where desired. The device (10) requires the shooter to use correct form when shooting a basketball. It teaches the shooter to shoot the ball every time in a straight line. It does this by teaching that the 10 important shooting concepts be followed when shooting the basketball elbow of the shooting arm must be perpendicular to the floor (major problem for shooters)

Stance/Alignment . . . using the device (10), the shooter's correct alignment is required . . . for a right handed shooter (right foot, right elbow, and ball in the middle of the enclosure—all are perfectly aligned) (also works for LH shooter)

Balance—the device (10) teaches the shooter to stay in the target line, not allowing the shooter to drift right or left . . .

Ball Balance—the ball must be balanced in the shooting hand, the enclosure does not allow the shot to be made with two hands Arm Straight to the target . . . the shooting arm must take the ball through the enclosure which is exactly to the target Eyes on the target . . . the enclosure funnels eyes to your target and makes focusing on the basket easier Lift and arch . . . the defensive hand forces the shooter to lift with the shooting arm, this teaches the importance of arch Shooting with a hand in your face . . . important to learn to shoot with defensive pressure—teaches mental toughness in shooting Follow through . . . 2 words will be printed on the defensive mechanism, "Follow Through", this will remind the shooter to finish the shot The role of the off hand . . . when shooting the enclosure does not let the left band come forward, but requires it to stay in its role as a control clamp on the ball.

The device (10) is designed to teach the shooter how to shoot every shot straight. As in shooting anything, lining up in a straight line to the target is paramount. The see through panels allow a coach or parent to observe the entire form of the shooter. The chute is designed to develop all shots of basketball, including free throws, 3 pointers, and jump shots.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A method for teaching a user proper basketball shooting techniques using a teaching device, the teaching device comprising: a first vertically disposed panel having a front edge, a rear edge, a top edge, and a bottom edge, said top edge of said first panel extending at least the height of the user's head, and said bottom edge of said first panel extending at least below the user's shoulder; a second vertically disposed panel having a front edge, a rear edge, a top edge, and a bottom edge, said top edge of said second panel extending at least the height of the user's head, and said bottom edge of said second panel extending at least below the user's shoulder; said rear edge of said first panel being disposed rearward of said rear edge of said second panel, said method comprising:

(a) positioning said teaching device on a floor surface with said front edge of said first panel in substantial alignment with a basketball rim, said second panel substantially parallel with and horizontally spaced from said first panel a distance at least half the width of user's shoulders but less than the width of user's entire shoulders;

(b) positioning the user in the teaching device such that the user's shooting arm is adjacent said first panel of said teaching device and forward of said rear edge of said first panel, the user's off-hand shoulder positioned rearward of said rear edge of said second panel of said teaching device; and (c) having the user shoot a basketball;

whereby during the shooting operation, said first panel of said teaching device prevents the user's shooting arm elbow from extending appreciably outwardly of the user's shooting arm shoulder thereby teaching the user to shoot the basketball with the user's shooting arm elbow substantially perpendicular to the floor surface throughout the shooting operation, said second panel of said teaching device preventing the user's off-hand from extending forwardly during the shooting operation the same distance as the user's shooting hand thereby teaching the user to shoot the basketball with only one hand, the off-hand thereby acting only to control the ball in the shooting hand prior to its release.

2. The method of claim 1 wherein said first and second panels of said teaching device are at least partially transparent such that the user's shooting form is viewable from all sides of said device.

3. The method of claim 1 wherein said teaching device further includes a vertically disposed L-shaped attachment panel having a bottom edge, a top edge, a first vertical edge attached to said rear edge of said second panel, and a second vertical edge extending rearwardly of said rear edge of said second panel.

4. The method of claim 3 wherein said attachment panel of said teaching device is at least partially transparent such that the user's shooting form is viewable from all sides of said device.

5. The method of claim 1 wherein said first and second panels of said teaching device are vertically adjustable.

6. The method of claim 1 wherein said first and second panels of said teaching device are horizontally adjustable.

7. The method of claim 1 wherein the first and second panels of said teaching device are invertible such that said teaching device is useable by both left-handed and right-handed users.

8. The method of claim 1 wherein said teaching device further includes a horizontally adjustable connector bar attached to and interconnecting said front edges of said first and second panels.

9. The method of claim 1 wherein said teaching device further includes a vertically adjustable defensive obstruction movably attached to said front edge of one of said first and second panels and being disposed to extend between said horizontally spaced first and second panels.

* * * * *